US008220085B2

(12) United States Patent
Claffy et al.

(10) Patent No.: US 8,220,085 B2
(45) Date of Patent: Jul. 17, 2012

(54) STACKABLE BED PLATFORM

(75) Inventors: Joseph R. Claffy, Western Springs, IL (US); Edward W. Claffy, Burr Ridge, IL (US)

(73) Assignee: VDL Industries, LLC, Willowbrook, IL (US)

( * ) Notice: Subject to any disclaimer, the term of this patent is extended or adjusted under 35 U.S.C. 154(b) by 5 days.

(21) Appl. No.: 12/137,001

(22) Filed: Jun. 11, 2008

(65) Prior Publication Data

US 2009/0307838 A1 Dec. 17, 2009

(51) Int. Cl.
*A47C 19/00* (2006.01)

(52) U.S. Cl. ..... 5/8; 5/110

(58) Field of Classification Search ..... 5/8, 110, 5/9.1, 201, 246, 247, 509.1, 625; 4/547; 128/870; 297/239, 452.14, DIG. 2; 441/129; D6/382, 503

See application file for complete search history.

(56) References Cited

U.S. PATENT DOCUMENTS 3,247,529 A 4/1966 Benton
3,414,914 A 12/1968 Gramins
3,835,482 A * 9/1974 Tersch ..... 4/573.1
4,234,977 A * 11/1980 Snow ..... 5/110
4,234,978 A 11/1980 Snow
D268,796 S 5/1983 Kola
4,583,252 A * 4/1986 McCourt ..... 4/584
4,584,729 A 4/1986 Roberts et al.
D288,636 S * 3/1987 McLaren ..... D6/383
4,879,774 A 11/1989 Sanders et al.
D306,243 S 2/1990 Livi
5,303,438 A * 4/1994 Walker ..... 5/652
D355,988 S 3/1995 Brooking
5,473,784 A * 12/1995 Nixon et al. ..... 5/625
5,490,292 A * 2/1996 Auburn ..... 5/8
6,715,170 B2 * 4/2004 Richmond ..... 5/625

* cited by examiner

*Primary Examiner* — Robert G Santos
*Assistant Examiner* — Nicholas Polito
(74) *Attorney, Agent, or Firm* — Vedder Price P.C.

(57) ABSTRACT

A stackable bed platform includes a primary sleep surface and a secondary sleep surface. The primary sleep surface includes a first bunk rail having a top edge formed by a first side wall, connected to a first end bunk rail having a top edge formed by a first end wall, connected to a second side bunk rail having a top edge formed by a second side wall, connected to a second end bunk rail having a top edge formed by a second end wall. The primary sleep surface also has a first supportive surface connected to the first side wall, the second side wall, the first end wall, and the second end wall. The secondary sleep surface includes a second supportive surface opposing the first supportive surface that is connected to the first side wall, the second side wall, the first end wall, and the second end wall.

26 Claims, 6 Drawing Sheets

STACKABLE BED PLATFORM

FIELD OF THE DISCLOSURE

The present disclosure generally relates to a bed, and more particularly, to a stackable bed platform.

BACKGROUND

Various situations can present a relatively immediate need for easily accessible beds. For example, correctional facilities (e.g., jails or prisons) often experience temporary or permanent overcrowding. As another example, temporary disaster relief centers may need a large number of temporary beds during times of disaster, as a homeless shelter may need extra beds during periods of extreme cold. Airports and transportation centers may also have a need for beds in certain situations but for which beds are not otherwise needed, such as during times of extreme weather that causes numerous travel delays. Thus, temporary sleep surfaces are required in these situations, as well as in other situations temporary sleep surfaces recognized by one of ordinary skill in the art.

These situations often require sleep surfaces that can withstand frequent and intense temporary use. Furthermore, temporary sleep surfaces should easily be stored while conserving space, be durable, be easy to clean, be ergonomic, be cost effective, be flame retardant (preferably passing the Cal 133 Technical Bulletin), and be functional. Additionally, a need exists for a temporary sleep surface that is aesthetically pleasing.

SUMMARY

A stackable bed platform includes a primary sleep surface and a secondary sleep surface opposite the primary sleep surface. The primary sleep surface includes a first bunk rail having a top edge formed by a first side wall, connected to a first end bunk rail having a top edge formed by a first end wall, connected to a second side bunk rail having a top edge formed by a second side wall, connected to a second end bunk rail having a top edge formed by a second end wall. The primary sleep surface also has a first supportive surface connected to the first side wall, the second side wall, the first end wall, and the second end wall.

The stackable bed also has a secondary sleep surface, which includes a second supportive surface opposing the first supportive surface and is connected to the first side wall, the second side wall, the first end wall, and the second end wall. The bottom edge of the first side wall forms a third side bunk rail opposing the first side bunk rail and a bottom edge of the second side wall forms a fourth side bunk rail opposing the second side bunk rail.

One embodiment of a stackable bed platform includes a plurality of structural cones connected to the second supportive surface.

In one embodiment, the primary sleep surface and the secondary sleep surface are formed from one mold.

In yet another embodiment, the stackable bed platform is formed from one piece.

One embodiment of a stackable bed platform includes at least one handle molded into either a sidewall or an end wall.

Another embodiment of a stackable bed platform includes a cylinder connecting the first supportive surface and the second supportive surface, thereby forming a hole operative as a vent/drain hole.

Another embodiment of a stackable bed platform includes an indentation of material in one of the supportive surfaces, thereby forming a channel for collecting moisture.

BRIEF DESCRIPTION OF THE DRAWINGS

The features of the present disclosure are believed to be novel and are set forth with particularity in the appended claims. The disclosure may best be understood by reference to the following description taken in conjunction with the accompanying drawings, and the figures that employ like reference numerals identify like elements.

DETAILED DESCRIPTION

Figure 1:
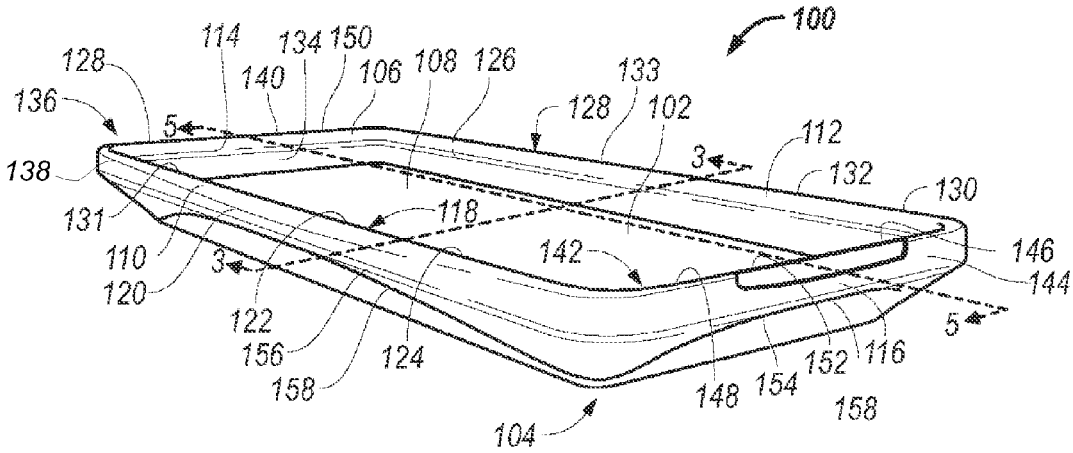
FIG. 1 is a perspective view of an example of a stackable bed platform in a first orientation.

For the purposes of promoting and understanding the principles disclosed herein, references are now made to the preferred embodiments illustrated in the drawings and specific language is used to describe the same. It is nevertheless understood that no limitation of the scope of the invention is thereby intended. Such alterations and further modifications in the illustrated device and such further applications of the principles disclosed as illustrated herein are contemplated as would normally occur to one skilled in the art to which this disclosure relates.

FIG. 1 shows an example of a stackable bed platform 100, which includes a primary sleep surface 102 and a secondary sleep surface 104 opposite of the primary sleep surface 102. It is noted, however, that the primary sleep surface 102 is designated as "primary" because it is the preferred sleep surface in this particular example, but it is also conceived that a user may designate the secondary sleep surface 104 as the primary one. In this particular example, the primary sleep surface 102 takes the form of a generally rectangular pan 106 while the secondary sleep surface 104, best shown in FIG. 2, has a flatter form, such as having a platform 202, without two side ends, as is further discussed throughout.

Figure 2:
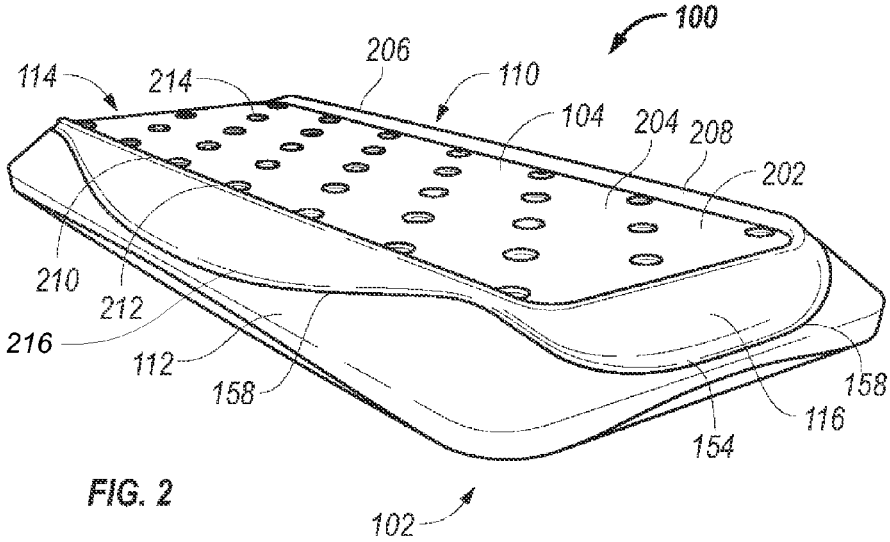
FIG. 2 is a perspective view of the stackable bed platform shown in FIG. 1 in a second orientation.

In one example, the stackable bed platform 100 is functional in both a first orientation, shown in FIG. 1, and also a second orientation, shown in FIG. 2. The two orientations are 180 degrees opposite of each other, and a user may choose a preferred orientation based on the desired use, e.g., the second orientation shown in FIG. 2 is more conducive for a taller person.

As shown in FIG. 1, the primary sleep surface 102 includes a supportive surface 108, which may be used for directly supporting one or more persons, a mattress, or any suitable item. It is understood that a mattress may be any suitable device or material suitable for providing a softer surface more conducive to comfortable sleeping. For example, a mattress could be a spring mattress, an air mattress, a foam pad, a blanket, or any other suitable device or material. It is understood, however, that a mattress is not required in any of the embodiments disclosed throughout, and for sanitary reasons, among others, not using a mattress is preferred in some situations. The primary sleep surface also includes a first side wall 110, a second side wall 112, a first end wall 114, and a second end wall 116, all of which are connected to the first supportive surface 108. Side wall 112 is connected to end wall 116, which is connected to side wall 110, which is in turn connected to end wall 114, which is also connected to side wall 112.

Figure 3:
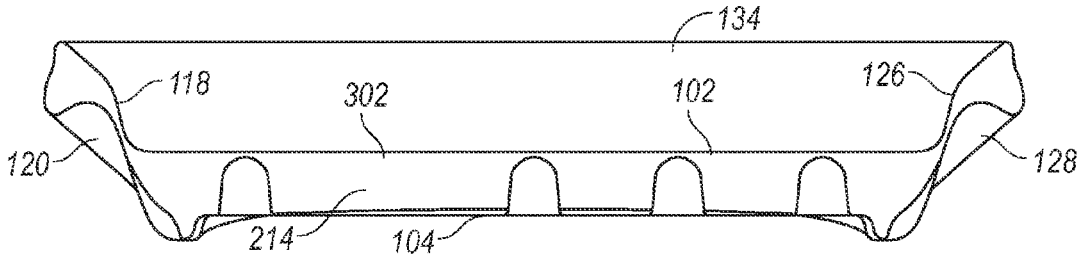
FIG. 3 is a cross sectional view of the stackable bed platform of FIG. 1 taken about line 3-3.
Figure 4:
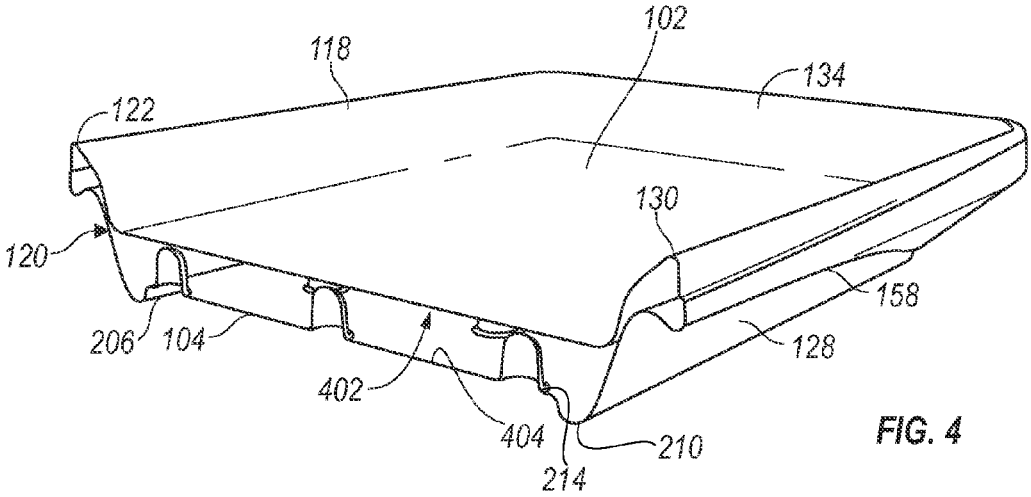
FIG. 4 is a perspective cross sectional view of the stackable bed platform of FIG. 1 taken about line 3-3.
Figure 5:
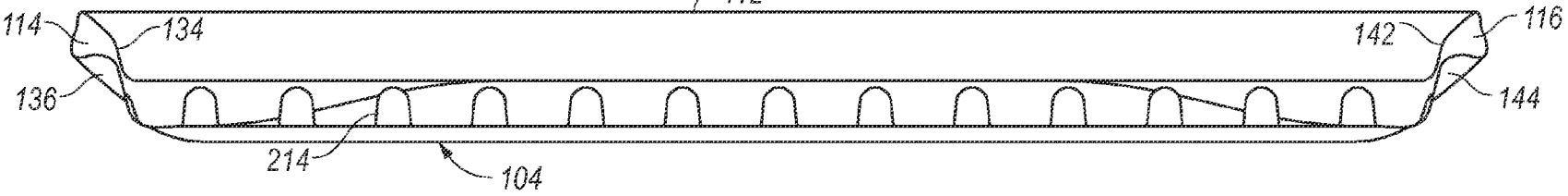
FIG. 5 is a cross sectional view of the stackable bed platform of FIG. 1 taken about line 5-5.
Figure 6:
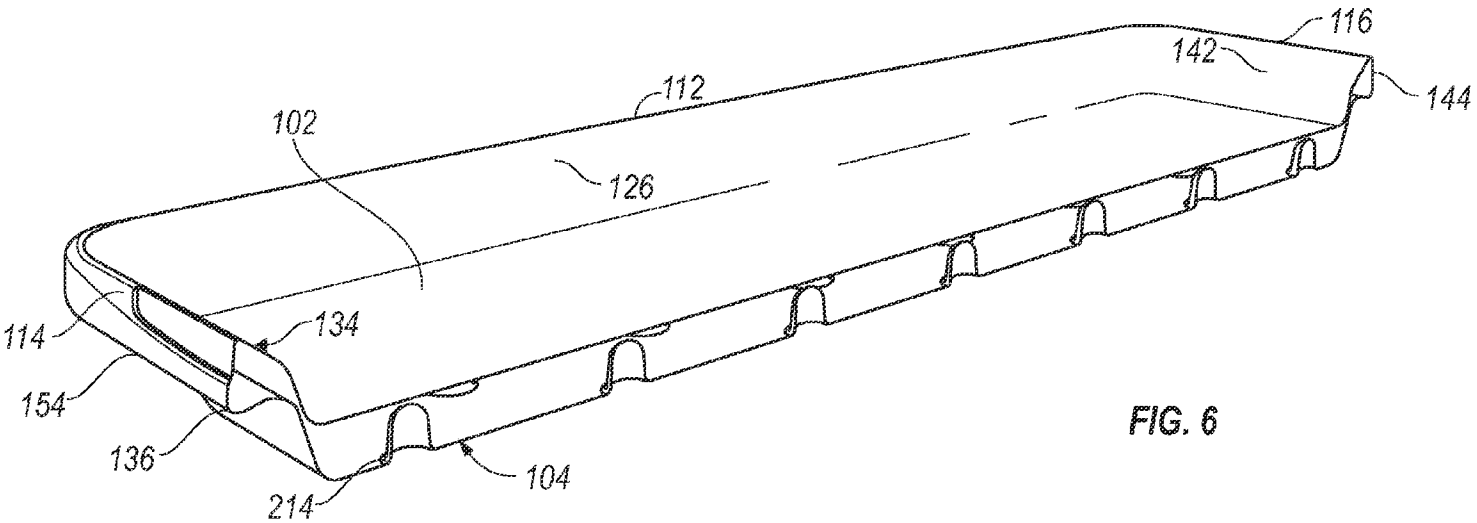
FIG. 6 is a perspective cross sectional view of the stackable bed platform of FIG. 1 taken about line 5-5.

Each side wall and end wall may have an inner side/end wall portion and an outer side/end wall portion. Each wall's inner and outer portions may be defined by opposite surfaces of one element, or as best shown in FIGS. 3 and 4, may be defined by different elements. For example, side wall 110 has inner side wall portion 118 connecting to outer wall portion 120 at shoulder 122. The shoulder 122 forms a top edge 124 of the side wall 110. Side wall 112 has inner side wall portion 126 connecting to outer wall portion 128 at shoulder 130. The shoulder 130 forms a top edge 132 of the side wall 112. Shoulders 122, 130 are relatively smooth and have an aesthetically pleasing curved surface, but it is understood that shoulders 122, 130 may take any suitable form. The portion of each side wall 110, 112 that extends beyond the supportive surface 108 defines side bunk rails 131, 133.

The end walls 114, 116 may also be formed similarly to the side walls 110, 112. For example, end wall 114 also includes an inner wall portion 134 and an outer wall portion 136. The inner wall portion 134 and outer wall portion 136 form shoulder 138, which has top edge 140. Similarly, end wall 116 includes inner wall portion 142 and outer wall portion 144 forming shoulder 146, which has top edge 148. The portion of each end wall 114, 116 that extends beyond the supportive surface 108 forms end rails 150, 152.

The secondary sleep surface 104 includes a second supportive surface 204 (i.e., a panel), which may support a mattress (or any other suitable item, such as a person, pillows, a blanket, etc.) when the stackable bed platform 100 is in the second orientation. As with the primary sleep surface, it may be preferred to use the secondary sleep surface without a mattress. The second supportive surface 204 opposes the first supportive surface 108 and is connected to the first side wall 110, the second side wall 112, the first end wall 114, and the second end wall 116. It is understood, however, that although all walls 110-116 connect the first supportive surface 108 and the second supportive surface 204, the supportive surfaces 108, 204 may be connected by any suitable number of walls (e.g., two, four, or more).

It is noted that in this particular example, it is the outer wall portions 120, 128, 136, 144 of the side/end walls 110, 112, 114, 116 that extend to ultimately connect the side and end walls 110, 112, 114, 116 to the second supportive surface. However, it is contemplated that the inner wall portions 118, 126, 134, 142 of the respective side/end walls 110, 112, 114, 116 may extend either instead of or along with the outer wall portions 120, 128, 136, 144 to connect the first supportive surface 108 to the second supportive surface 204.

Each side wall has a bottom edge forming a side bunk rail on opposing sides of the secondary sleep surface 104. For example, side wall 110 extends to a bottom edge 206 to form a third side bunk rail 208, which opposes the first bunk rail 131. Similarly, side wall 112 extends to bottom edge 210 to form a fourth side bunk rail 212, which opposes the second bunk rail 133.

It is noted that the secondary sleep surface 104 of this example embodiment does not include rails on the ends. As one skilled in the art will appreciate, this may allow the secondary sleep surface 104 to accommodate a taller person (without a mattress) or a longer mattresses (in situations in which a mattress is used) for taller people or for other suitable needs. Thus, in one example, the stackable bed platform 100 in the first orientation shown in FIG. 1 may accommodate a mattress that is no larger than 30 inches by 75 inches. The stackable bed platform 100 in the second orientation shown in FIG. 2, however, may accommodate a mattress 25 inches wide by 75 inches long or longer, in one example. The reason that the width of the mattress is only 25 inches in the second orientation, compared to the 30 inches of the first orientation, is due to the angled sides 110, 112, which are further discussed below.

The stackable bed platform 100 also includes various features that increase the maximum strength and decrease the deflection under weight when in use. For example, sidewalls 110, 112 and end walls 114, 116 may each include a support member, generally designated as 158 on all side walls and end walls. As best seen in FIGS. 1 and 2, the support members 158 take a generally arched form. This structure increases the strength of the sides by allowing the sides to support more weight without deflection, as one skilled in the art will appreciate. In one example, the support members 158 may be molded into the side walls 110, 112 and end walls 114, 116. Although a rotational molding process is preferred, any suitable molding process known in the art may be used.

The stackable bed platform 100 may also include one or more structural cones 214, which are best shown in FIGS. 3-6. The structural cones are connected to one supportive surface, such as the second supportive surface 204, and may be best shown on inner surface 404 in FIG. 4. The structural cones 214 may be indentations of material in one of the supportive surfaces and may serve several purposes. For example, in the example embodiment shown in FIG. 2 where the structural cones 214 form holes in the supportive surface 204, the cones 214 may collect moisture, i.e., the cones are formed by an indentation of material that forms a channel for collecting moisture. Perhaps more importantly, however, the apex 302 of each structural cone 214 may come into contact with the inner surface 402 of the first supportive surface 108. As one skilled in the art will appreciate, the structural cones 214 may add both comfort and durability. For example, if weight is applied to one of the supportive surfaces, the structural cones 214 may help distribute the weight so that the center of the supportive surface does not sag as much. Furthermore, the supportive surface turned downward that does not contain the mattress also carries some of the weight because of the structural cones. Other advantages will be recognized by one having ordinary skill in the art.

Other features of the example stackable bed 100 include, for example, a cylinder connecting the first supportive surface 108 to the second supportive surface 204, thereby forming a hole operative as a vent/drain hole 902. The vent/drain hole 902 is best shown by comparing FIG. 7 with FIG. 9 and FIG.

Figure 7:
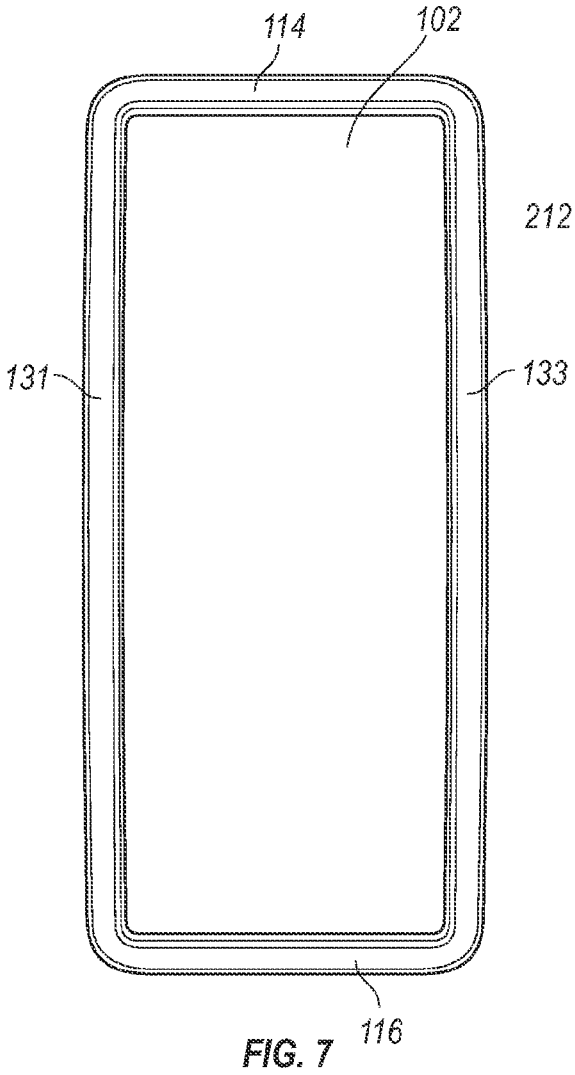
FIG. 7 is a top view of the stackable bed platform shown in FIG. 1 in a first orientation with the primary sleep surface oriented upward.
Figure 8:
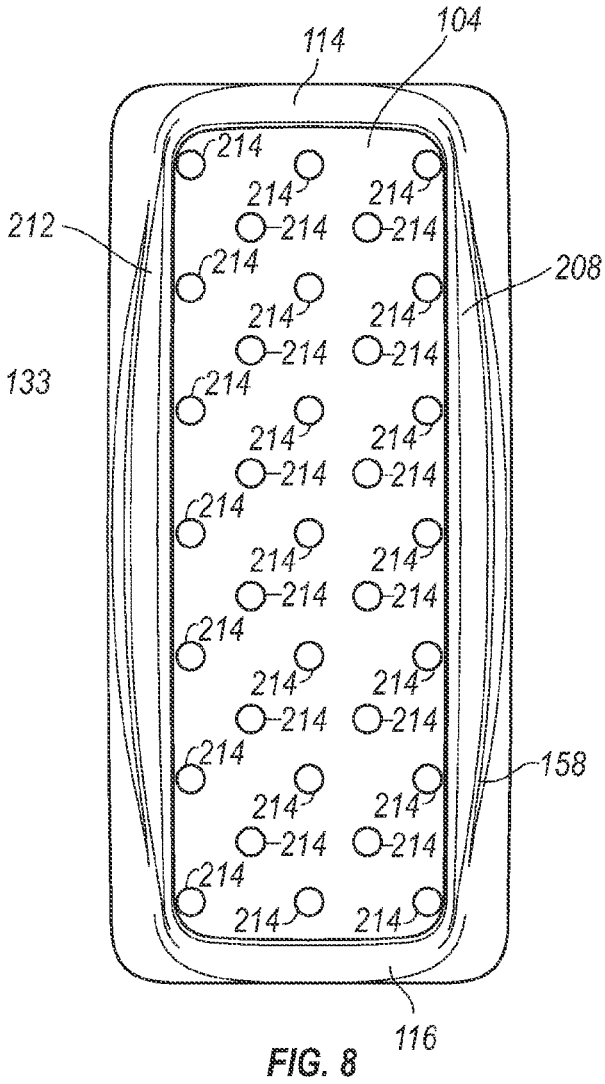
FIG. 8 is a top view of the stackable bed platform shown in FIG. 1 in a second orientation with the secondary sleep surface oriented upward.
Figure 9:
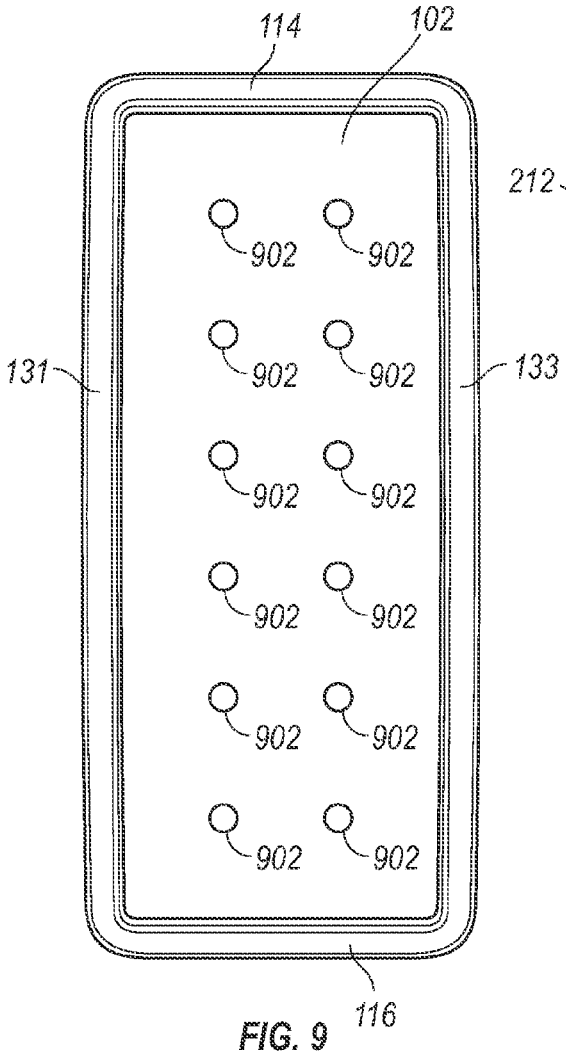
FIG. 9 is a top view of an example embodiment of a stackable bed platform in a first orientation with the primary sleep surface oriented upward having vent/drill holes.
Figure 10:
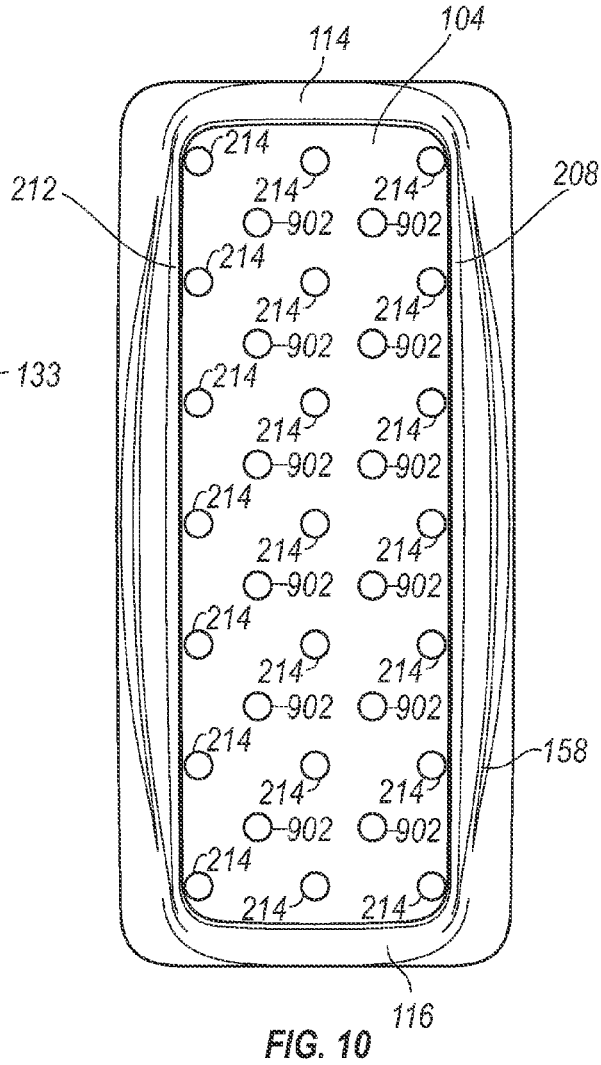
FIG. 10 is a top view of the example embodiment of the stackable bed platform shown in FIG. 9 in a second orientation with the secondary sleep surface oriented upward having vent/drill holes.

8 with FIG. 10. FIG. 7 shows a top view with the stackable bed 100 in a first orientation, i.e., with the primary sleep surface 102 facing upward. As shown, the primary sleep surface 102 does not have any vent/drain holes. FIG. 9, however, shows a top view of an example embodiment of a stackable bed wherein the primary sleep surface 102 has vent/drain holes 902. The distinction of the vent/drain holes 902 is also shown by comparing FIG. 8 (no vent/drain holes) and FIG. 10 (includes vent/drain holes). FIG. 8 is a top view of a stackable bed in a second orientation, i.e., an orientation with the secondary sleep surface 104 facing upwards, in which there are no vent/drain holes. FIG. 10, however, shows another example embodiment of a stackable bed in a second orientation, which includes vent/drain holes 902, which correspond to the vent/drain holes 902 shown in FIG. 9. It is also noted that both the embodiment shown in FIG. 8 and the embodiment shown in FIG. 10 includes structural cones 214, although an embodiment without any structural cones (not shown) is also contemplated. It is also contemplated that another embodiment may include internal structural cones that are not visible on the external of any sleep surface, such as primary sleep surface 102 or secondary sleep surface 104.

It is also contemplated that the vent/drain hole 902 may not have a cylinder (i.e., a tunnel) connecting the two supportive surfaces 108, 204. As such, the optional vent/drain holes 902 may be factory drilled or field drilled. As a vent hole, the hole 902 may allow air to circulate beneath a person using the platform. When functioning as a drain hole, hole 902 may allow moisture to be carried away from a person using the bed platform.

Stackable bed 100 may also include handles. For example, stackable bed 100 may include handle 154 on end wall 116 (as well as another handle (not shown) on end wall 114), handle 156 on side wall 110, and handle 216 on side wall 112. The handles 154, 156, 216 may be separate pieces connected to the respective walls 110, 112, 114, 116, or alternatively, as shown, each handle 154, 156, 216 may be formed by a mold when forming each side 110, 112, 114, 116. Forming the handles 154, 256, 216 by mold is preferred, however, because it allows the stackable bed 100 to more easily stack with other stackable beds, among other things.

Figure 11:
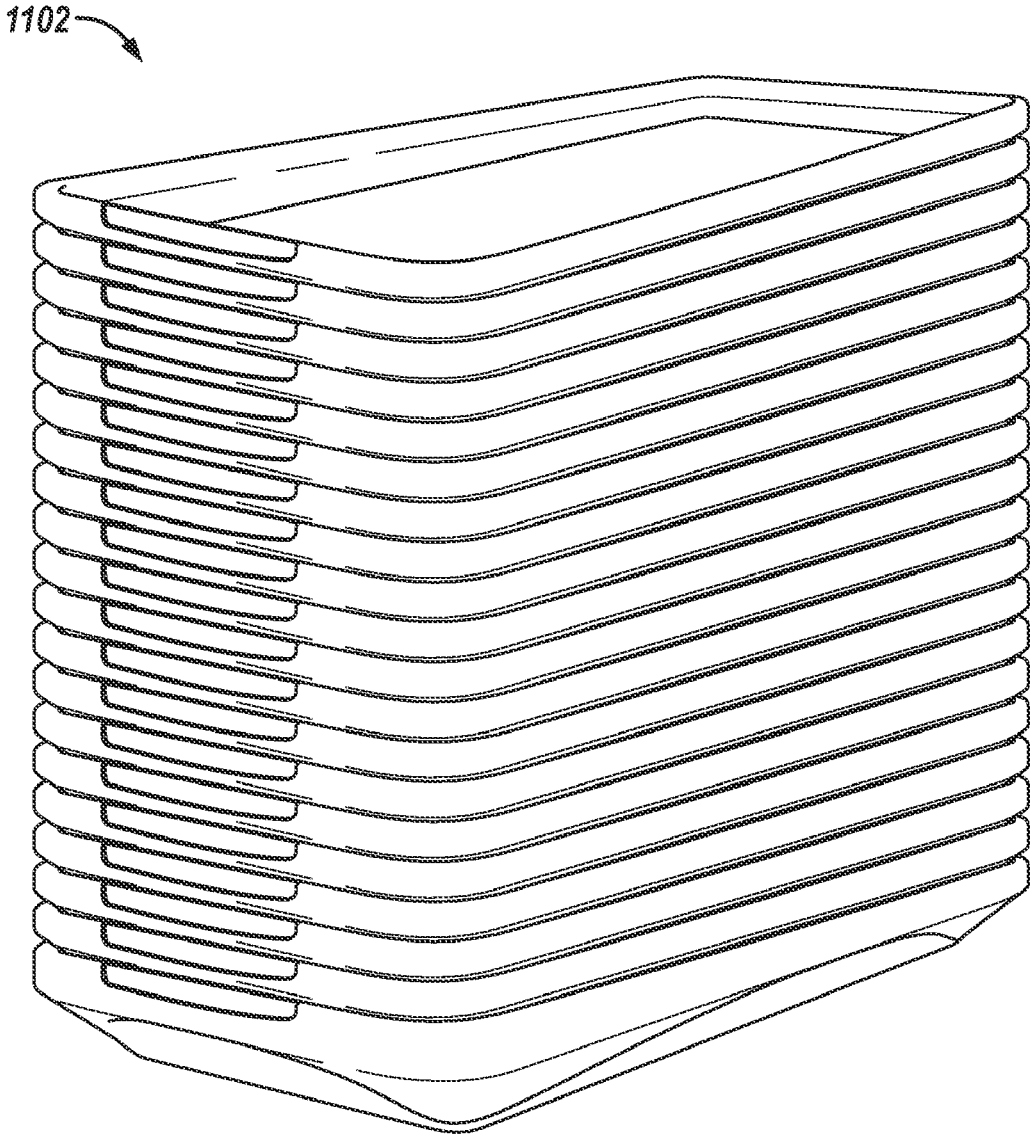
FIG. 11 is a perspective view showing an example of a plurality of stackable and nestable bed platforms in a stacked configuration.

Because of the design of stackable bed 100, stackable bed 100 may conveniently stack with other stackable beds, preferable identical stackable beds. FIG. 11, for example, shows a stack 1102 of stackable beds 100. The design of the stackable bed is such that the secondary sleep surface 104 fits within a portion of the pan 106 that is formed, in part, by the primary sleep surface 102. Among other things, this allows the stack 1102 to be more stable and take up less vertical space. It is noted that angled sidewalls 110, 112 and angled end walls 114, 116 help achieve a preferred nestable, stackable bed platform, as one skilled in the art will appreciate. In one example, a stack of twenty-one stackable beds 100 may stand 6.5 feet tall. Furthermore, depending on the design (e.g., how tall side rails 131, 133 and end rails 150, 152 stand), the stackable beds 100 may be stacked along with a mattress. In one example, the beds may stack and properly nest along with mattresses 3.5 inches thick (or less).

Several features of the stackable bed platform 100 promote more desirable stacking capabilities. For example, as noted above, the width of the primary supportive surface 108 is greater than the width of the second supportive surface 204. Thus, sidewalls 110, 112 may be angled such that the distance between rail 131 and rail 133 is greater than the distance between rail 208, 212, thereby allowing a secondary sleep surface 104 of one stackable bed to be inserted into the pan 106 of the primary sleep surface. As such, the bottom edges 206, 210 of the rails 208, 212 on one stackable bed may nearly abut the first supportive surface 108 of another stacked stackable bed. One skilled in the art will also appreciate that the rails 131, 133 associated with the primary sleep surface 102 are taller than the rails 208, 212 associated with the secondary sleep surface 204. In one example, rails 131, 133 may be 4 inches tall while rails 208, 212 may only be 2 inches tall. Furthermore, secondary sleep surface 204 may not have rails 208, 212.

The stackable bed platform disclosed within is preferably formed with a one-step or multi-step molding process, such as a rotational molding process that may form a one-piece bed platform. As such, the bed platform preferably has no seams or holes (with the exception of drain holes, if desired). As one skilled in the art will appreciate, a one-piece bed platform with a generally smooth surface and rounded edges and corners provides for easy cleaning and maintenance, among other things. Furthermore, providing a one-piece bed platform is also advantageous because it does not contain removable parts, which could be removed and potentially used as a weapon. Other advantages will be recognized by one having ordinary skill in the art.

It is understood by one of ordinary skill in the art that these elements and devices correspond to the general elements to be used to practice this disclosure. Other auxiliary elements may be used, but they do not affect the validity and completeness of this general concept of the disclosure. Persons of ordinary skill in the art appreciate that although the teachings of the disclosure have been illustrated in connection with certain embodiments, there is no intent to limit the invention to such embodiments. On the contrary, the intention of this application is to cover all modifications and embodiments falling fairly within the scope of the teachings of the disclosure.

What is claimed is:

1. A reversible stackable bed platform comprising:

a primary flat sleep surface including:

a first side bunk rail having a top edge formed by a first side wall, connected to a first end bunk rail having a top edge formed by a first end wall, connected to a second side bunk rail having a top edge formed by a second side wall, connected to a second end bunk rail having a top edge formed by a second end wall; and a first supportive surface connected to the first side wall, the second side wall, the first end wall, and the second end wall, the first supportive surface having a first width defined by a distance along the first supportive surface between the first side wall and the second side wall;

a secondary flat sleep surface, opposite the primary sleep surface, including:

a second supportive surface opposing the first supportive surface, connected to the first side wall, the second side wall, the first end wall, and the second end wall, the second supportive surface having a second width defined by a distance along the second supportive surface between the first side wall and the second side wall, wherein the second width is less than the first width, and further wherein bottom edges of one stackable bed platform nearly abut the first supportive surface of another stackable bed platform such that a plurality of the stackable bed platforms stack one inside another;

a support means for providing support that minimizes the deflection of the primary and the secondary sleep surfaces when in use as a sleep surface; and wherein the secondary sleep surface includes ends without rails.

2. The stackable bed platform of claim 1 further comprising:

a plurality of structural cones connected to the second supportive surface.

3. The stackable bed platform of claim 1 wherein the primary sleep surface and the secondary sleep surface are formed from one mold.

4. The stackable bed platform of claim 1 further comprising:

a first handle on the first side wall; and a second handle on the second side wall.

5. The stackable bed platform of claim 1 further comprising:

a third handle on the first end wall; and a fourth handle on the second end wall.

6. The stackable bed platform of claim 1, wherein each top edge of the first side wall and the second side wall each forms a shoulder with an inner side wall portion extending from the top edge and an outer side wall portion extending from the top edge.

7. The stackable bed platform of claim 1 further comprising:

a cylinder connecting the first supportive surface and the second supportive surface and forming a hole therethrough operative as a vent/drain hole.

8. The stackable bed platform of claim 1, wherein a bottom edge of the first side wall forms a third side bunk rail opposing the first side bunk rail and a bottom edge of the second side wall forms a fourth side bunk rail opposing the second side bunk rail.

9. The reversible stackable bed platform of claim 1 wherein the first supportive surface further has a first length defined by a distance along the first supportive surface between, the first end wall and the second end wall, and the second supportive surface further has a second length defined by a distance along the second supportive surface between the first end wall and the second end wall, wherein the second length is less than the first length such that a plurality of the stackable bed platforms stack one inside another.

10. A reversible stackable bed platform comprising:

a first flat supportive panel, for use when the stackable bed platform is in a first orientation;

a second flat supportive panel, for use when the stackable bed platform is in a second orientation, connected to the first supportive panel by a first side wall and a second side wall having a secondary flat sleep surface including ends without rails;

the first supportive panel made from a first layer of material and the second supportive panel made from a second layer of material;

a plurality of structural cones connected on an inner face of the second supportive panel that opposes the first supportive panel; and the first flat supportive panel having a first width defined by a distance along the first flat supportive panel between the first side wall and the second side wall, and the second flat supportive panel having a second width defined by a distance along the second flat supportive panel between the first side wall and the second side wall, wherein the second width is less than the first width, and further wherein bottom edges of one stackable bed platform nearly abut the first supportive surface of another stackable bed platform such that a plurality of the stackable bed platforms stack one inside another.

11. The stackable bed platform of claim 10 wherein the first side wall extends, from the second supportive panel, beyond the first supportive panel to form a side bunk rail having a top edge.

12. The stackable bed platform of claim 11 wherein the top edge of the side wall forms a shoulder having:

an inner side wall portion extending from the first supportive panel to the top edge;

and an outer side wall extending from the top edge to the second supportive panel.

13. The stackable bed platform of claim 12 wherein the outer side wall forms a second shoulder at a bottom edge of the side wall thereby forming a second bunk rail associated with the second supportive panel.

14. The stackable bed platform of claim 10, wherein the first supportive panel and the second supportive panel are formed from the same mold.

15. The stackable bed platform of claim 14, wherein the stackable bed platform is one piece of material.

16. The reversible stackable bed platform of claim 10 wherein the first flat supportive panel further has a first length defined by a distance along the first flat supportive panel between a first end wall and a second end wall, and the second flat supportive panel further has a second length defined by a distance along the second flat supportive panel between the first end wall and the second end wall, wherein the second length is less than the first length such that a plurality of the stackable bed platforms stack one inside another.

17. A stackable bed platform comprising:

a first flat supportive panel, for use when the stackable bed platform is in a first orientation;

a second flat supportive panel, for use when the stackable bed platform is in a second orientation, connected to the first supportive panel by a first side wall, a second side wall, a first end wall, and a second end wall, the first flat supportive panel having a first width defined by a distance along the first flat supportive panel between the first side wall and the second side wall, and the second flat supportive panel having a second width defined by a distance along the second flat supportive panel between the first side wall and the second side wall, wherein the second width is less than the first width, and further wherein bottom edges of one stackable bed platform nearly abut the first supportive surface of another stackable bed platform such that a plurality of the stackable bed platforms stack one inside another; and a support member including an arch molded in and substantially co-planar with at least one of: the first side wall, the second side wall, the first end wall, and the second end wall.

18. The stackable bed platform of claim 17 further comprising:

a plurality of structural cones connected on an inner face of the second supportive panel that opposes the first supportive panel.

19. The stackable bed platform of claim 17 wherein the first flat supportive panel further has a first length defined by a distance along the first flat supportive panel between the first end wall and the second end wall, and the second flat supportive panel further has a second length defined by a distance along the second flat supportive panel between the first end wall and the second end wall, wherein the second length is less than the first length such that a plurality of the stackable bed platforms stack one inside another.

20. A reversible stackable bed platform comprising:

a primary flat sleep surface including:

a first side bunk rail having a top edge formed by a first side wall, connected to a first end bunk rail having a top edge formed by a first end wall, connected to a second side bunk rail having a top edge formed by a second side wall, connected to a second end bunk rail having a top edge formed by a second end wall; and a first supportive surface connected to the first side wall, the second side wall, the first end wall, and the second end wall, the first supportive surface having a first width defined by a distance along the first supportive surface between the first side wall and the second side wall;

a secondary flat sleep surface, opposite the primary sleep surface, including:

a second supportive surface opposing the first supportive surface, connected to the first side wall, the second side wall, the first end wall, and the second end wall, the second supportive surface having a second width defined by a distance along the second supportive surface between the first side wall and the second side wall, wherein the second width is less than the first width, and further wherein bottom edges of one stackable bed platform nearly abut the first supportive surface of another stackable bed platform such that a plurality of the stackable bed platforms stack one inside another; and a plurality of support members for supporting weight and minimizing the deflection of the primary and secondary sleep surfaces, wherein the secondary sleep surface includes ends without rails.

21. The reversible stackable bed platform of claim 20, wherein a support member is an arch molded in and substantially co-planar with at least one of the first side wall, the second side wall, the first end wall, and the second end wall.

22. The reversible stackable bed platform of claim 20, further comprising:

a support member comprising a plurality of cones connected to the second supportive surface.

23. The reversible stackable bed platform of claim 20, further comprising:

a support member comprising a plurality of cones connected to the second supportive surface for distributing weight to prevent sagging of the second supportive structure.

24. The reversible stackable bed platform of claim 20, further comprising:

a support member comprising a plurality of cones connected to the second supportive surface formed into holes for collecting moisture.

25. The reversible stackable bed platform of claim 20, further comprising:

a cylinder connected the first supportive surface and the second supportive surface and forming a hole therethrough operative as a vent/drain hole.

26. The reversible stackable bed platform of claim 20 wherein the first supportive surface further has a first length defined by a distance along the first supportive surface between the first end wall and the second end wall, and the second supportive surface further has a second length defined by a distance along the second supportive surface between the first end wall and the second end wall, wherein the second length is less than the first length such that a plurality of the stackable bed platforms stack one inside another.

* * * * *